US007726414B2

(12) United States Patent
Berger et al.

(10) Patent No.: US 7,726,414 B2
(45) Date of Patent: Jun. 1, 2010

(54) HOLLOW PISTON HAMMER DEVICE WITH AIR EQUILIBRATION AND IDLE OPENINGS

(75) Inventors: Rudolf Berger, Grunwald (DE); Wolfgang Schmid, Munich (DE)

(73) Assignee: Wacker Neuson SE, Munich (DE)

( * ) Notice: Subject to any disclaimer, the term of this patent is extended or adjusted under 35 U.S.C. 154(b) by 48 days.

(21) Appl. No.: 11/930,839

(22) Filed: Oct. 31, 2007

(65) Prior Publication Data

US 2008/0073096 A1 Mar. 27, 2008

Related U.S. Application Data

(63) Continuation of application No. 10/559,485, filed on Dec. 6, 2005, now abandoned.

(51) Int. Cl.
*B25D 9/04* (2006.01)

(52) U.S. Cl. ..... 173/201; 173/212; 173/132

(58) Field of Classification Search ..... 173/13, 173/90, 201, 202, 204, 212, 102, 103
See application file for complete search history.

(56) References Cited

U.S. PATENT DOCUMENTS

| | | | | | |
|---|---|---|---|---|---|
| 747,752 | A * | 12/1903 | Murphy | 173/15 |
| 1,184,687 | A * | 5/1916 | Golly | 74/583 |
| 1,402,727 | A * | 1/1922 | Seaboldt et al. | 173/14 |
| 2,638,749 | A * | 5/1953 | Sparano | 60/542 |
| 3,559,751 | A * | 2/1971 | Yamada | 173/201 |
| 3,688,848 | A * | 9/1972 | Vick et al. | 173/201 |
| 4,290,492 | A * | 9/1981 | Sides et al. | 173/118 |
| 5,111,890 | A * | 5/1992 | Ranger et al. | 173/104 |
| 5,775,440 | A * | 7/1998 | Shinma | 173/109 |
| 5,842,527 | A * | 12/1998 | Arakawa et al. | 173/48 |
| 5,873,418 | A * | 2/1999 | Arakawa et al. | 173/212 |
| 5,975,217 | A * | 11/1999 | Frenzel et al. | 173/201 |
| 6,119,796 | A * | 9/2000 | Schmid | 173/201 |
| 6,237,700 | B1 * | 5/2001 | Berger et al. | 173/201 |
| 6,431,290 | B1 * | 8/2002 | Muhr et al. | 173/201 |
| 6,523,622 | B1 | 2/2003 | Berger et al. | |
| 6,568,484 | B1 * | 5/2003 | Schmid et al. | 173/201 |
| 6,644,418 | B2 * | 11/2003 | Haga | 173/48 |
| 6,808,026 | B2 * | 10/2004 | Berger et al. | 173/201 |
| 7,040,413 | B2 * | 5/2006 | Mueller et al. | 173/13 |
| 7,325,624 | B2 * | 2/2008 | Yamazaki | 173/48 |

(Continued)

FOREIGN PATENT DOCUMENTS

DE 198 43 645 C1 3/2000

(Continued)

*Primary Examiner*—Rinaldi I. Rada
*Assistant Examiner*—Lindsay Low
(74) *Attorney, Agent, or Firm*—Boyle Fredrickson, S.C.

(57) ABSTRACT

An air spring hammer device that includes a drive piston, moving axially back and forth, with a front face of hollow embodiment and a hammer piston moving in said hollow. A ventilation slot is embodied in a guide wall of the drive piston. The drive piston may be guided in a guide tube. The guide tube comprises several idle openings. A moving control element is arranged on the exterior of the guide tube, in which control openings, corresponding to the idle openings, are provided. In an idle operating mode, the control element is in an open position, via which the ventilation slot, the idle openings and the control openings can be brought into connection with the environment.

15 Claims, 8 Drawing Sheets

U.S. PATENT DOCUMENTS

| | | | | |
|---|---|---|---|---|
| 2003/0094292 | A1* | 5/2003 | Haga | 173/48 |
| 2003/0178213 | A1* | 9/2003 | Meixner | 173/201 |
| 2004/0177981 | A1* | 9/2004 | Berger | 173/201 |
| 2006/0076154 | A1* | 4/2006 | Aoki | 173/212 |

FOREIGN PATENT DOCUMENTS

| | | | |
|---|---|---|---|
| WO | WO00/16948 | * | 3/2000 |
| WO | WO02/060652 | * | 8/2002 |

* cited by examiner

HOLLOW PISTON HAMMER DEVICE WITH AIR EQUILIBRATION AND IDLE OPENINGS

CROSS REFERENCE TO RELATED APPLICATION

This application is a continuation application of presently co-pending U.S. application Ser. No. 10/559,485, filed May 6, 2005, and entitled "Hollow Piston Hammer Device with Air Equilibration and Idle Openings," the entirety of which is incorporated herein by reference.

BACKGROUND OF THE INVENTION

1. Field of the Invention

The present invention relates to a pneumatic spring hammer device.

Pneumatic spring hammer devices are standardly used in drilling and/or striking hammers (called "hammers" in the following) in order to exert impacts on a tool at regular intervals. For this purpose, a design has proven successful in which a drive sets a drive piston into an axial back-and-forth motion that is transmitted to an impact piston via an air spring that arises in a hollow space between the drive piston and the impact piston. Finally, the impact piston strikes the tool or a header situated between the piston and the tool.

In a preferred design for such a pneumatic hammer device, the drive piston is fashioned so as to be hollow on its front side, the impact piston being guided in the cavity of the drive piston. This is also referred to as a hollow piston hammer device.

This design has proven to be very successful in practice; due to the low mass of the drive piston only slight idle oscillations occur, and no seal is required between the pistons. However, a disadvantage is that the transition between idle operation and impact operation does not always take place with the desired degree of precision, resulting in a higher risk of idle hammering when the operator actually desires to change over to idle operation. Impacts with lower intensity, or even undesired idle operation, can also result if the operator does not press the hammer fully against the material to be processed, or if the impact piston recoil does not take place. In both cases, operability and/or work results are adversely affected.

2. Description of the Related Art

From U.S. Pat. No. 6,523,622 B1, a hollow piston hammer device having a return spring is known. Here a control disk is provided that interrupts a connection to the return spring when there is a changeover between impact operation and idle operation, while an idle opening is moved over an air duct, so that a hollow space that accommodates the air spring can be brought into connection with the surrounding environment.

In DE 198 47 687 A1, a hollow piston hammer device having sleeve controlling is described. The sleeve controlling enables a reliable and precise changeover between idle operation and impact operation, using a control sleeve that can be axially displaced. When the control sleeve is in the idle position, the hollow space formed between the drive position and the impact piston.

The hollow piston hammer device according to DE 198 47 687 A1 has performed outstandingly in practice. Nonetheless, it has been noted that improvements could be made with respect to its strength and sealing properties.

OBJECT OF THE INVENTION

The object of the present invention is therefore to improve a hollow piston hammer device in order to achieve an optimized sealing and oscillation behavior, while retaining a reliable changeover between idle operation and impact operation.

According to the present invention, this object is achieved by a pneumatic spring hammer device having the features of patent claim 1. Advantageous further developments of the present invention are defined in the dependent claims.

In the pneumatic spring hammer device according to the present invention, a drive piston that can be moved back and forth axially, and whose cavity guides an axially movable impact piston, is equipped with a ventilation slot in its sleeve-shaped guide wall. The outside of the guide wall can be guided on an inner side of a guide tube, which thus also guides the drive piston as a whole. This design is known from DE 198 47 687 A1.

According to the present invention, in the guide tube one or more idle openings are provided that are distributed in the axial direction and that extend in the radial direction. The plurality of idle openings can be situated on a line in the axial direction, or can also be distributed on the circumference of the guide tube with an axial offset.

If only one idle opening is present, it is to be situated at a location suitable for achieving the subsequent effect according to the present invention.

On the outside of the guide tube, a movable control element is situated in which there are provided control openings corresponding to the idle openings. The control element can be moved between an open position and a closed position. In the open position, at least one of the control openings is positioned over an idle opening, while in the closed position the control openings and the idle openings are not positioned one over the other, so that the idle openings are all sealed by the wall of the control element.

In an idle operating mode of the hammer device, the control element is in the open position, so that the hollow space inside the drive piston can be brought into communicating connection with the surrounding atmosphere via the ventilation slot, the idle openings, and the control openings, and the air spring formed in the hollow space can be ventilated.

If only one idle opening is provided in the guide wall of the drive piston, it is to be situated in such a way that the communicating connection can be created in the idle operating mode.

Thus, in contrast to the prior art, the drive piston of the pneumatic spring hammer device according to the present invention has only the one (or more) ventilation slot(s), but does not have any additional idle openings, as are indicated in DE 198 47 687 A1, or also in DE 198 28 426 A1. In this way, between the drive piston and the guide tube surrounding it there exist fewer opening transitions that must be sealed. In addition, the guide wall of the drive piston is not weakened by additional openings, which has a positive effect on its strength characteristic. Here, care is to be taken that the guide wall of the drive piston is made as thin as possible, in order to keep the overall mass of the drive piston as low as possible. In this way, the oscillations of the drive piston resulting from its back-and-forth motion can be minimized. If the guide wall was very thin and in addition was perforated by numerous idle openings, during manufacture or in operation strength problems could occur that could result in an undesired deformation of the guide wall, and thus of the drive piston.

In addition, in impact operation the hollow space surrounding the air spring is completely isolated from the surrounding environment. In contrast to the prior art, here there is no risk that the hollow space could be at least partly bled via an incompletely sealed idle opening, which would result in a decrease of tension of the air spring in the hollow space and thus to a lower impact energy of the impact piston. Due to the fact that the drive piston does not have any idle openings, this risk is excluded in principle by the design of the present invention.

In a particularly advantageous specific embodiment of the present invention, the axial length of the ventilation slot is greater than the axial height of a piston head, guided in the drive piston, of the impact piston. This has the result that in impact operation a relative position between the drive piston and the impact piston is possible in which the hollow space surrounding the air spring can be brought into communicating connection with a space in front of the impact piston. This creates the possibility of supplying new air to the hollow space and refilling the air spring before the next impact.

In addition, it is advantageous if the axial length of the ventilation slot is greater than the minimum axial distance between the edges closest to one another of axially adjacent idle openings. This construction ensures that in idle operation, i.e. when the control element is in an open position, the ventilation slot is situated over at least one idle opening, independent of the relative position between the drive piston and the guide tube. If one end of the ventilation slot moves away from one idle opening due to the movement of the drive piston, the other end of this slot reaches the next idle opening before the first end has left the first idle opening. In the transition phase between two idle openings, the ventilation slot is thus simultaneously (at least partially) situated over both idle openings. In this way, it is ensured that at all times a communicating connection from the hollow space to the surrounding environment is possible via the ventilation slot.

Advantageously, the number of idle openings and control openings is the same. In this way, the overall cross-section of the idle openings can be maximized in order to achieve an effective ventilation of the hollow space in idle operation.

In a preferred specific embodiment of the present invention, the control element is held in the open position by a spring device. In this way, it is ensured that the hammer device runs in idle operation, if the operator does not take any further measures. When the tool is placed on the stone that is to be processed, the control element can then be pushed into its closed position against the action of the spring, as is also described in principle in DE 198 47 687 A1.

The pneumatic spring hammer device is equally well-suited for pure impact hammers (breaking hammers) and for drilling hammers.

In another construction of the present invention, the control element is realized as a control sleeve that surrounds the guide tube. Here, the drive piston is situated so as to be secured against rotation, while the guide tube and the control sleeve are capable of being rotated in common relative to the drive piston. This specific embodiment of the pneumatic spring hammer device is particularly well-suited for a drilling hammer, in which, besides the impact movement, a rotational movement must also be transmitted to the tool.

In order to enable a reliable connection of the hollow space and the ventilation slot or slots to the surrounding environment, in this specific embodiment it is very useful if an annular inner groove is provided on the inside of the guide tube at the height of each idle opening. Thus, if for example the guide tube has three idle openings, three inner grooves should be allocated to these openings on the inside of the guide tube, so that a communicating connection to the idle openings can be created independent of the relative position between the drive piston and the guide tube.

These and additional features and advantages of the present invention are explained in more detail below with the aid of the accompanying Figures.

DETAILED DESCRIPTION OF THE PREFERRED EMBODIMENT

Figure 1A:
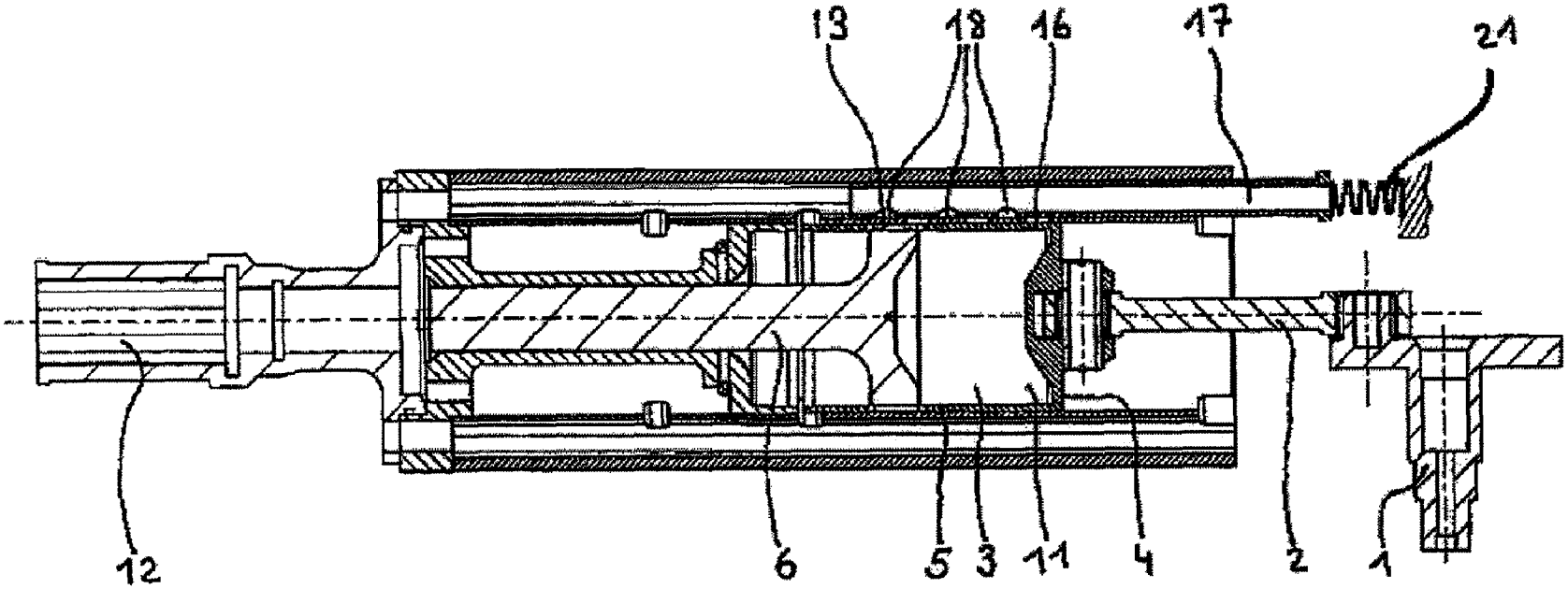
FIG. 1*a* shows a sectional representation of a pneumatic spring hammer device according to the present invention for a breaking hammer in the impact operation position.
Figure 1B:
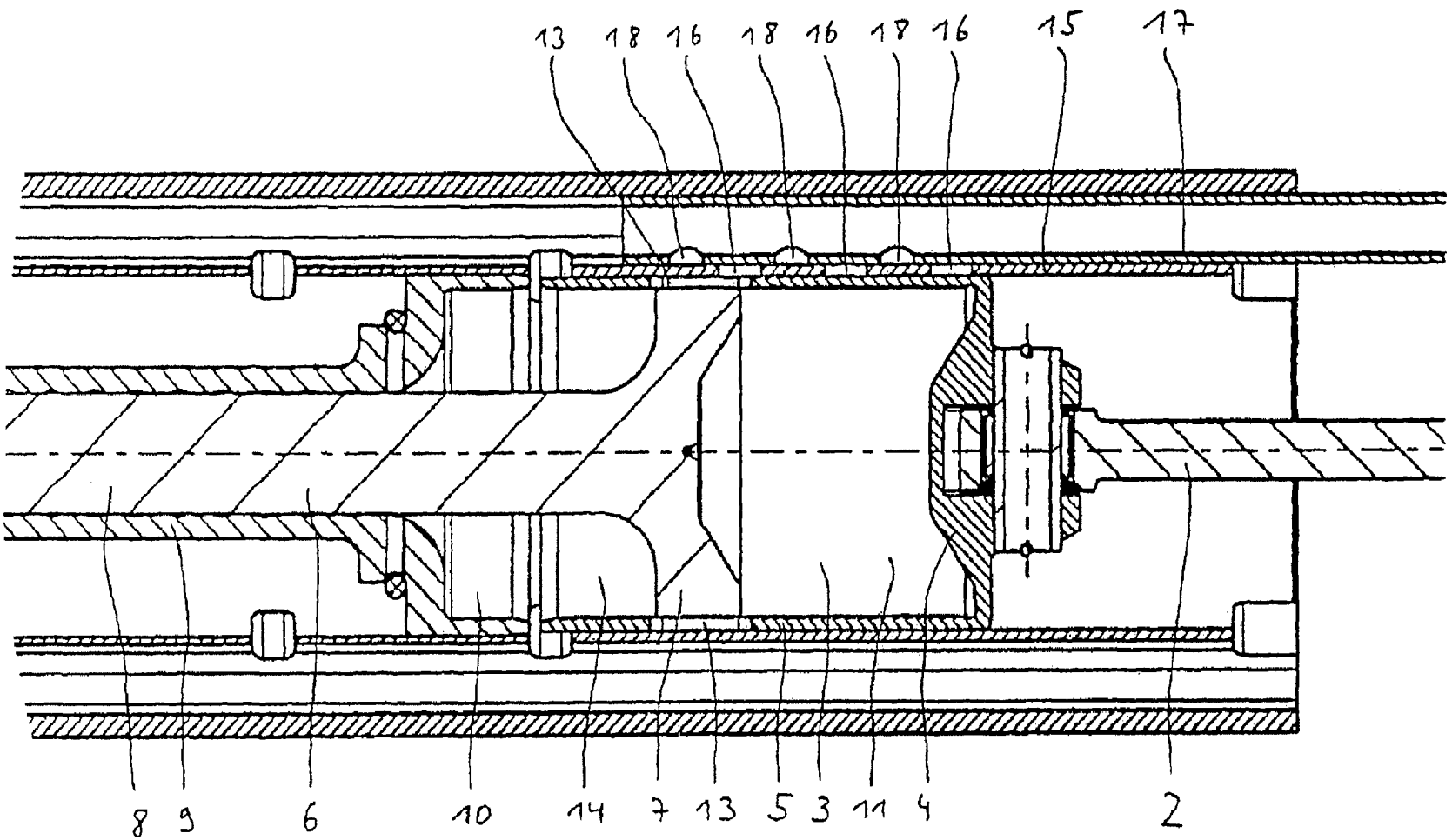
FIG. 1*b* shows an enlarged detail of FIG. 1*a;*
Figure 2A:
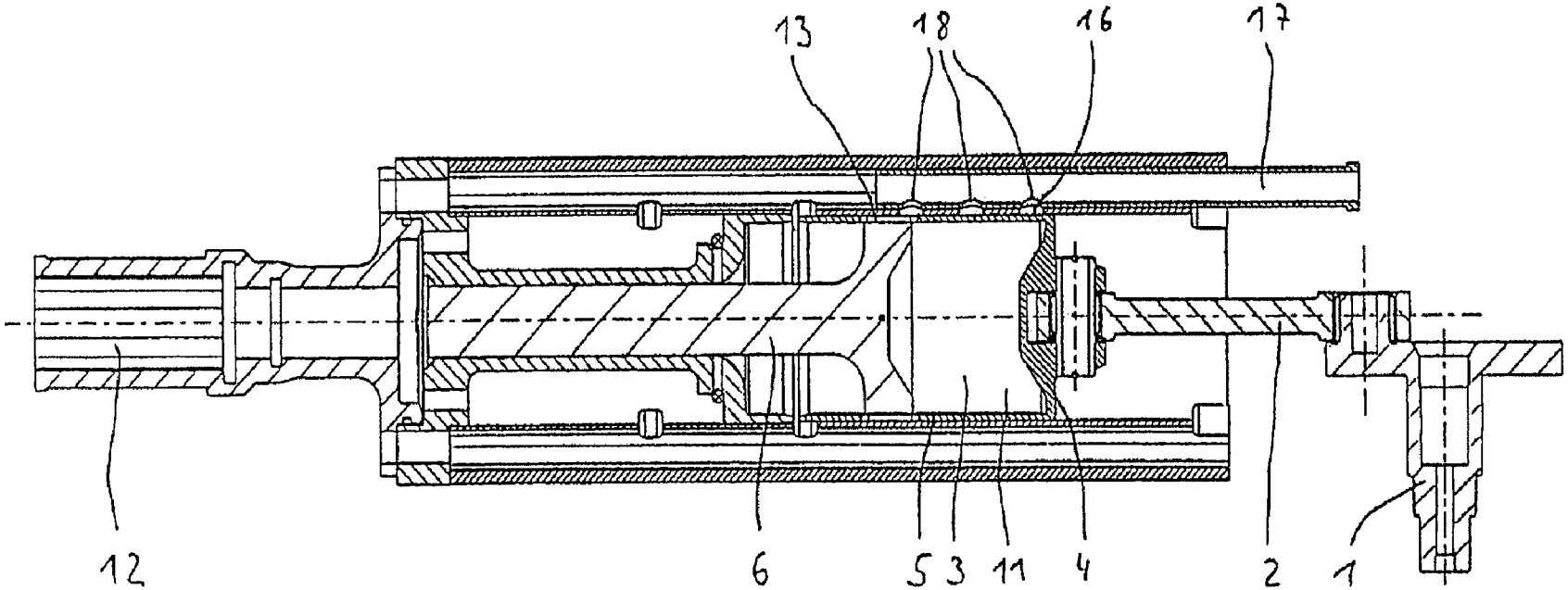
FIG. 2*a* shows a sectional representation of the pneumatic spring hammer device according to the present invention for a breaking hammer in the idle operating position.
Figure 2B:
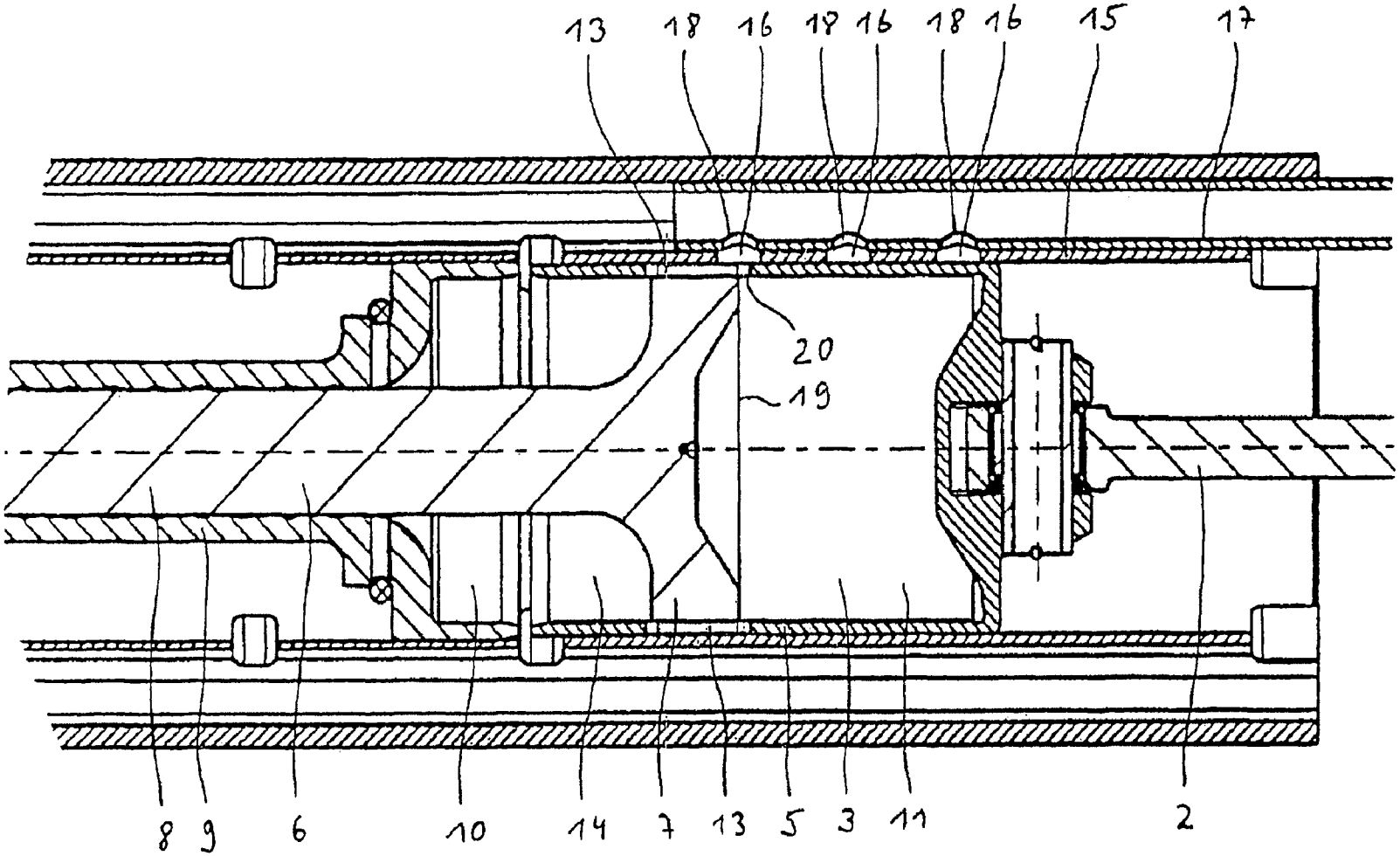
FIG. 2*b* shows an enlarged detail of FIG. 2*a;*
Figure 3A:
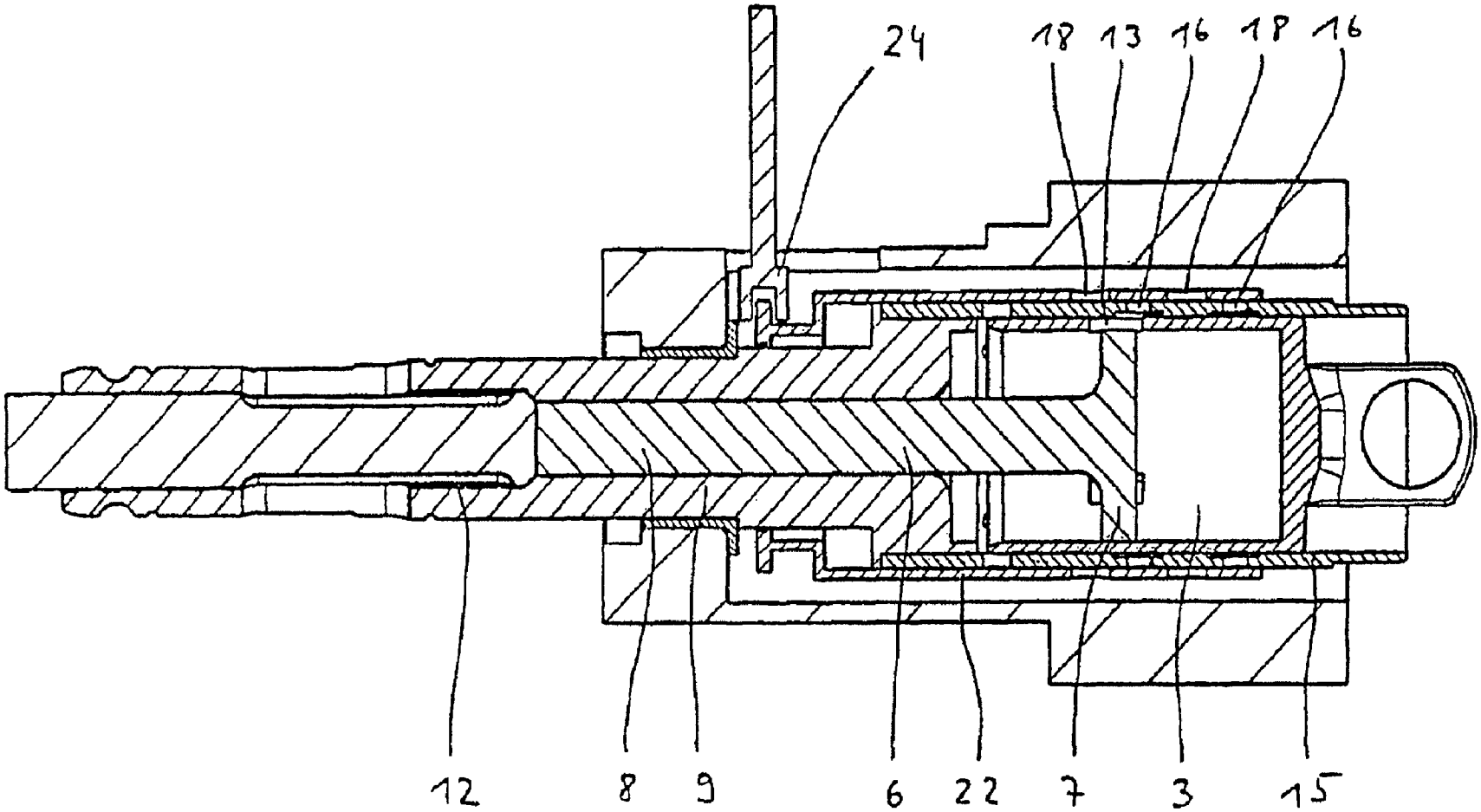
FIG. 3*a* shows a sectional representation of another pneumatic spring hammer device according to the present invention for a drilling hammer in the impact operating position.
Figure 3B:
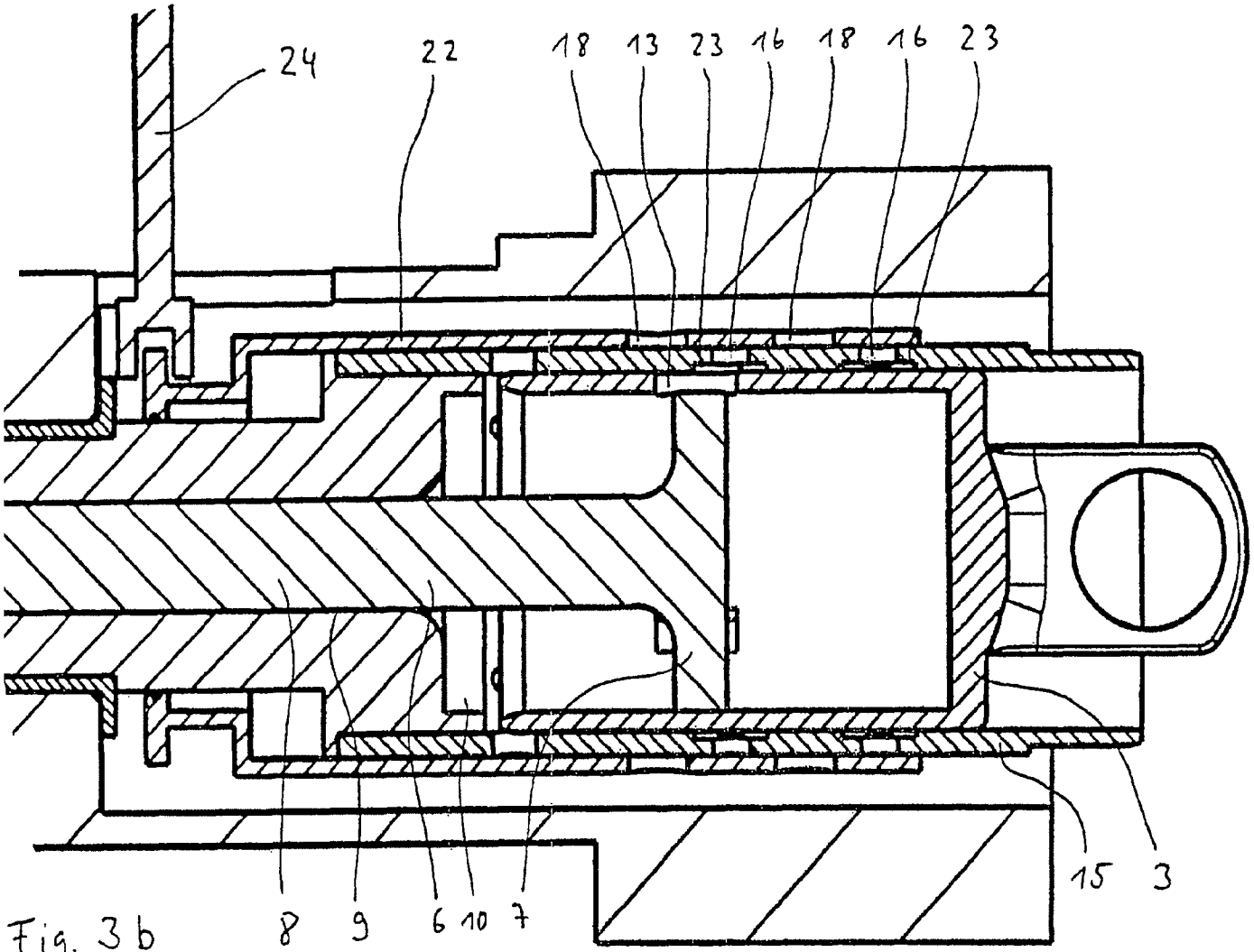
FIG. 3*b* shows an enlarged detail of FIG. 3*a;*
Figure 4A:
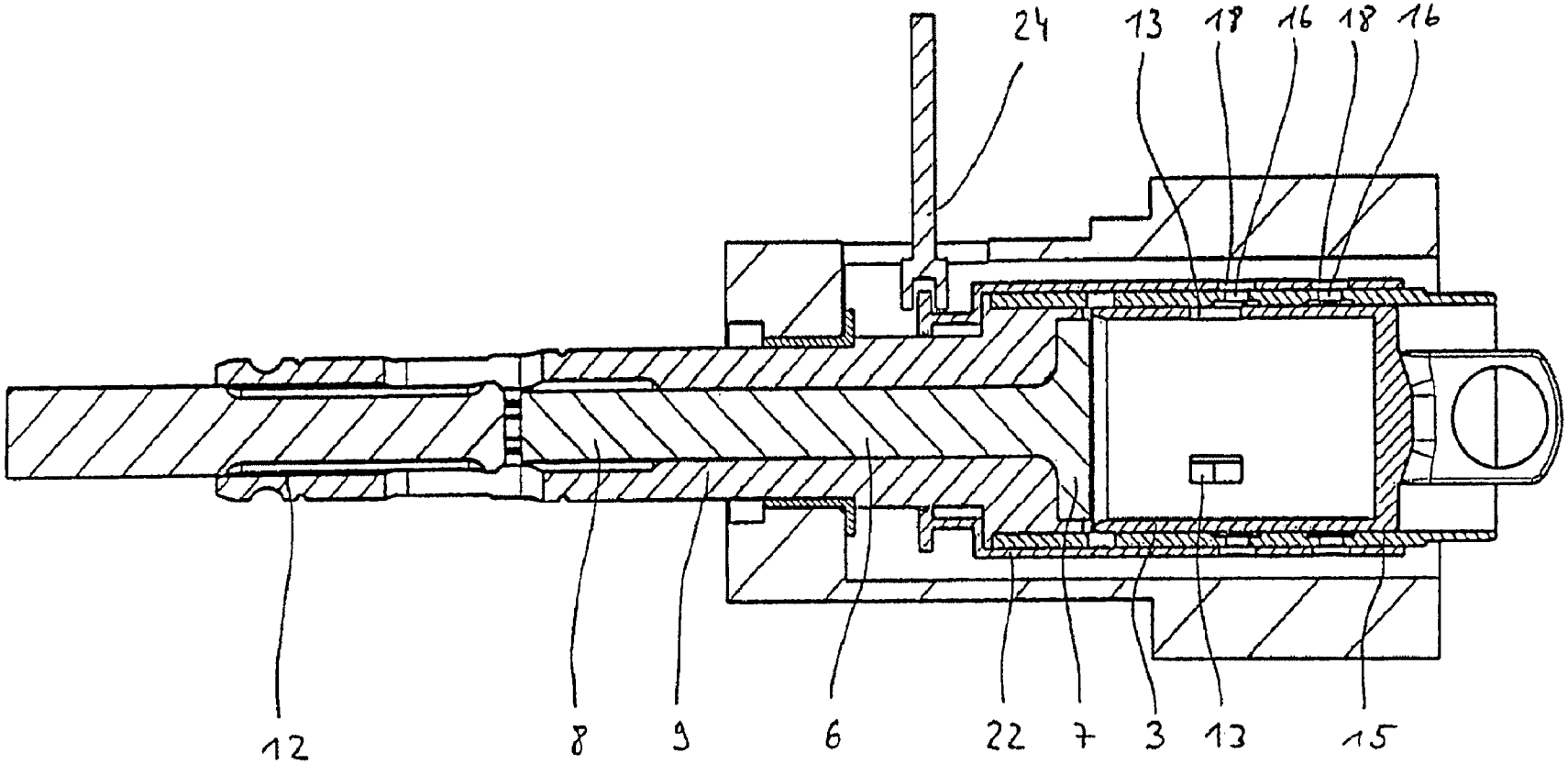
FIG. 4*a* shows a sectional representation of the other pneumatic spring hammer device according to the present invention for a drilling hammer in the idle operating position.
Figure 4B:
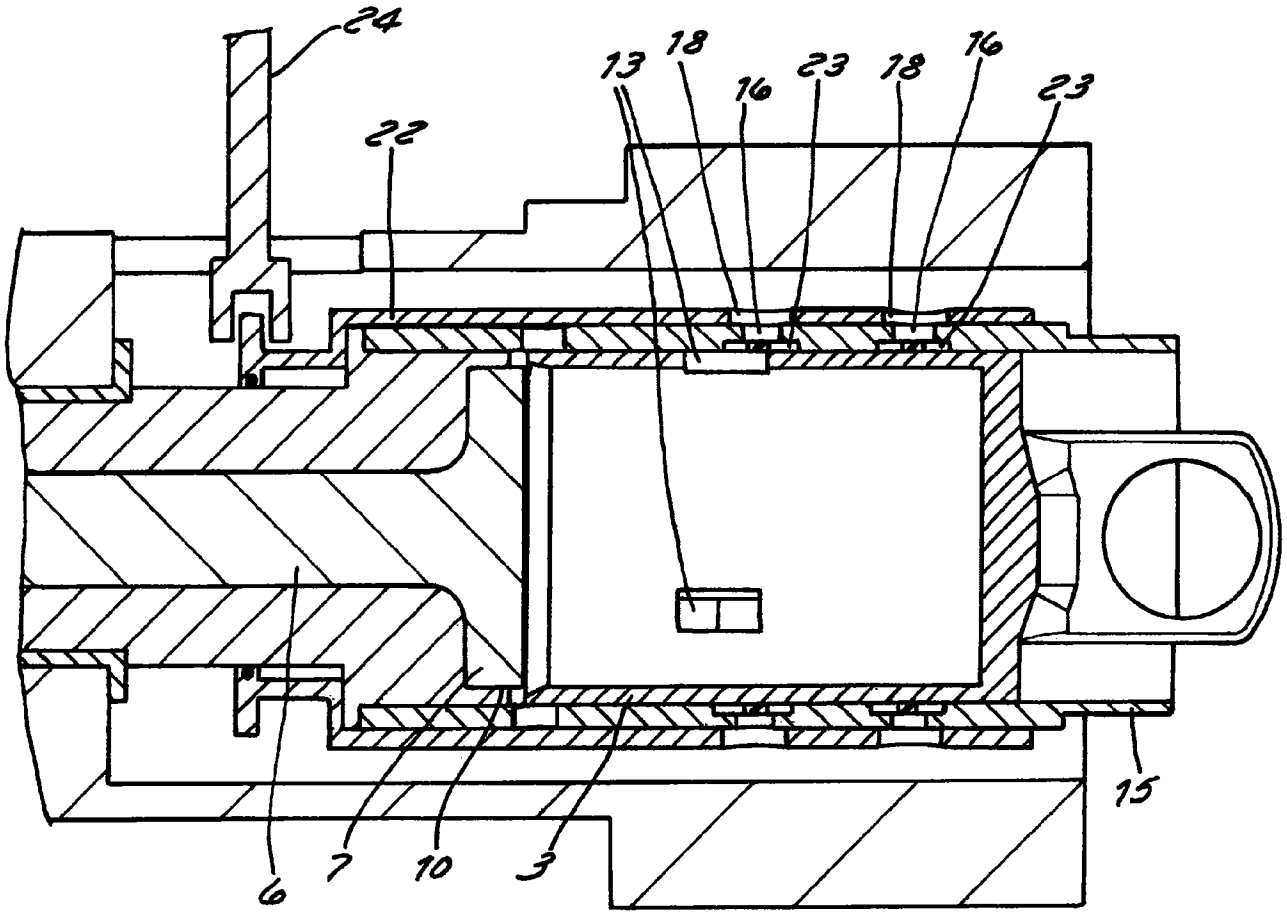
FIG. 4*b* shows an enlarged detail of FIG. 4*a.*

Because FIG. 1*b* shows only an enlarged detail of FIG. 1*a* for the illustration of details of the present invention, in the following FIGS. 1*a* and 1*b* will be referred to together as "FIG. 1." The same holds for FIGS. 2*a* and 2*b* (FIG. 2), FIGS. 3*a* and 3*b* (FIG. 3), and FIGS. 4*a* and 4*b* (FIG. 4).

FIG. 1 schematically shows a part of a breaking hammer having the pneumatic spring hammer device according to the present invention. A crankshaft 1 driven in rotational fashion by a drive (not shown) moves a connecting rod 2 back and forth, to which a drive piston 3 is fastened in a known manner. Drive piston 3 has a piston top 4 to which connecting rod 2 is fastened, as well as a sleeve-shaped guide wall 5.

Inside guide wall 5, an impact piston 6 is guided with its piston head 7. In addition, a shaft 8 of impact piston 6 is guided in a guide tube 9 fixed to the housing. In addition, for the accommodation of piston head 7 an impact piston receptacle 10 is present into which the piston head 7 can slide in the idle operating state. This design is described for example in DE 101 03 996 C1. However, it is not relevant to the subject matter of the present invention, so that no further description of it is necessary here.

A hollow space 11 is formed between impact piston 6, or its piston head 7, and drive piston 3. When drive piston 3 moves back and forth, an air spring arises in hollow space 11 that periodically drives impact piston 6 forward in the direction of a tool (not shown) that can be placed in a tool receptacle 12, so that in this way impact piston 6 strikes the tool in a known manner. When drive piston 3 moves back, a suction effect is created that draws impact piston 6 back, so that the next impact can then begin.

In guide wall 5 of drive piston 3, two ventilation slots 13 situated opposite one another are provided that extend in the axial direction of drive piston 3 and that completely penetrate guide wall 5. The axial length of ventilation slots 13 is dimensioned so that it is greater than an axial height of piston head 7 of the impact piston. In this way, in the relative position shown in FIG. 1 between drive piston 3 and impact piston 6 it is possible for air to flow from an antechamber 14, situated in front of piston head 7, into hollow space 11 via ventilation slots 13. In this way, it is possible, during the course of an impact and the concomitant compression of the air spring, to compensate leakage losses that occur in hollow space 11. During each stroke, via ventilation slots 13 the air spring is refilled from antechamber 14, which in turn draws air from the surrounding environment.

Ventilation slot or slots 13 need not necessarily be oblong, i.e., extended in the axial direction. Rather, what are called the "ventilation slots" 13 can be breakthrough openings in the guide wall of drive piston 3, having an arbitrary shape and arbitrary cross-section. Larger openings (rectangular, circular, etc.) having a comparatively larger tangential extension are also possible.

Drive piston 3 is guided in a guide tube 15 in such a way that the outside of guide wall 5 of the drive piston slides along the inside of guide tube 15. The designation "guide tube" does not mean that guide tube 15 must be completely tubular. It requires only that guide tube 15 surround drive piston 3 in a manner suitable to guide it reliably in a housing of the hammer and to seal ventilation slots 13 in a suitable manner. Further details of the construction of guide tube 15, in particular on its outside, are unimportant for this.

In guide tube 15, a plurality of idle openings 16 (in FIG. 1: three idle openings 16) are formed that extend in the radial direction. Idle openings 16 can be distributed on a line in the axial direction, as is visible for example in FIG. 1. Alternatively, it is also possible to situate the idle openings in a manner offset to one another, i.e., distributed over the circumference of the guide tube, should this prove advantageous.

Idle openings 16 are situated in axial positions in such a way that it is ensured that at least one of the ventilation slots 13 (the upper one in FIG. 1) is positioned over at least one of the idle openings 16 at least at times during the stroke of drive piston 3. The length of ventilation slot 13 and the axial spacing of idle openings 16 are here dimensioned such that if necessary two idle openings 16 are simultaneously passed over by ventilation slot 13. Care is to be taken that there is no position in which ventilation slot 13 is not positioned directly over at least one of the three idle openings 16. Nonetheless, proper functioning is also possible when ventilation slot 13 is not positioned over an idle opening 16.

On the outside of guide tube 15, a control element 17 is provided. Control element 17 can be moved axially back and forth between a closed position, shown in FIG. 1, and an open position, shown in FIG. 2, that is explained in more detail below.

The control element shown in FIGS. 1 and 2 can be a rod-shaped small tube in whose wall radial control openings 18 are formed. The number of control openings 18 should correspond to the number of idle openings 16. Thus, in FIG. 1 three control openings 18 are also shown. In addition, the axial spacing of control openings 18 is dimensioned such that each of the control openings 18 can be moved over an allocated idle opening 16. Control openings 18 lead to the surrounding environment of the pneumatic spring hammer device, i.e., for example into the rest of the interior of the hammer, or also to the surrounding environment of the device. Here the terms "surrounding environment" or "surrounding atmosphere" do not necessarily refer to the surroundings of the work device that is using the pneumatic spring hammer device, but rather primarily the surroundings of the pneumatic spring hammer device itself, where, for example in the crankshaft chamber or in the chamber situated in front of the impact piston sufficient volume is available to ensure an effective air and pressure compensation with hollow space 11 in the interior of the hammer device.

FIG. 1 shows impact operation, in which control element 17 is in the closed position, so that control openings 18 are not positioned over idle openings 16, and idle openings 16 are completely covered by control element 17. Here, the best possible sealing of idle openings 16 is to be sought.

FIG. 2 shows the same hammer device, but in idle operation.

For this purpose, control element 17 has been axially displaced somewhat, so that control openings 18 are positioned over idle openings 16.

Because, as described above, ventilation slot 13 is positioned over at least one of idle openings 16, there is a communicating connection between ventilation slot 13, the relevant idle opening 16, and allocated control opening 18.

As soon as a rear edge 19 of piston head 7 has passed a rear edge 20 of ventilation slot 13, there is in addition a communicating connection to hollow space 11, as is shown in FIG. 2. As a result, the air spring situated in hollow space 11 can be ventilated to the surrounding environment via ventilation slot 13, idle opening 16, and control opening 18.

The communicating connection is not interrupted until control element 17 moves back into its closed position (FIG. 1), so that a pressure can again form in the air spring in hollow space 11.

Control element 17 is preferably loaded by a spring device 21 in such a way that in the normal position it is in its open position (idle operation). Through corresponding measures on the part of the operator, e.g. by placing the tool onto the stone that is to be processed, a pressure force can be transmitted to control element 17, so that control element 17 is displaced into its closed position and the hammer begins its operation. Further details of the construction of the switching of the pneumatic spring hammer device are not the subject matter of the present invention, and can be learned for example from DE 198 47 687 A1.

FIGS. 3 and 4 show another specific embodiment of a pneumatic spring hammer device according to the present invention, in this case for application in a drilling hammer that, in addition to an impact movement, also exerts a rotational movement on the tool. Components having essentially the same or similar functions as in the first specific embodiment of the present invention are identified with identical reference characters.

The essential difference between the two specific embodiments according to FIGS. 1, 2 on the one hand and FIGS. 3, 4 on the other hand is to be found in the construction of the control element as control sleeve 22.

Because, as described above, in addition to the impact movement a rotational movement must also be produced (which, however, is not in itself part of the subject matter of the present invention), drive piston 3 must additionally be held secure against rotation, while guide tube 15 surrounding it must be capable of rotation. Impact piston 6 either rotates with guide tube 15 or moves only axially, without additional rotational motion. This depends on the friction conditions between piston head 7 of impact piston 6 and drive piston 3 on the one hand, and shaft 8 of impact piston 6 and guide tube 9 on the other hand.

Because guide tube 15 rotates, the control element is realized as a control sleeve 22 that surrounds guide tube 15 at its circumference. Guide tube 15 and control sleeve 22 are situated rotationally secure to one another, so that it is ensured that idle openings 16 and control openings 18 can be moved over one another. Guide tube 15 and control sleeve 22 are thus capable of being moved axially to one another, but are fixed in relation to one another in the circumferential direction.

In order further to ensure that ventilation slot 13 can communicate with at least one idle opening 16 in any relative position between drive piston 3 and guide tube 15, i.e., both in the axial direction and also in the circumferential direction, an annular inner groove 23 is allocated to each idle opening 16 on the inside of guide tube 15. Inner grooves 23 ensure that, independent of the relative rotational position of drive piston 3 to guide tube 15, it is always possible to create a communicating connection between ventilation slot 13 and idle opening 16.

Via a selector fork 24, shown schematically, or a selector collar, control sleeve 22 can be moved axially back and forth in order to reach the open position or the closed position. Here, the same rules hold as in the specific embodiment described above in connection with FIGS. 1 and 2.

The present invention enables a shortening of the idle path through ventilation of the compression chamber (hollow chamber 11) via lateral piston openings (ventilation slots 13). This results in a shortening of the overall constructive length of the hammer. In addition, the piston can have a particularly short construction, resulting in a further shortening of the hammer's constructive length, and saving weight.

Due to the complete absence of idle openings in the drive piston, the risk of drawing leaked-in air during suction (drawing back) of impact piston 6 is reduced. This holds all the more since there is no increasing overall cross-section of (non-existent) idle openings oriented toward the open end of drive piston 3.

Rear edge 20 of ventilation slot 13 simultaneously acts as a rear control edge for the ventilation of the hammer device. In this way, the compression chamber in hollow chamber 11 has no additional ventilation bores, which could, given insufficient sealing, result in a loss of air. Nonetheless, an immediate ventilation of hollow space 11 is possible when rear edge 20 crosses over in the idle state or the weak impact state.

Due to the small number of openings in guide wall 5 of drive piston 3, formed exclusively by ventilation slots 13, a better stability of drive piston 3 is achieved with the same wall thickness; it is even possible to reduce the wall thickness. In this way, for example recesses that run around the circumference, or that run axially, on the outside of guide sleeve 5 are possible in order to reduce friction.

Finally, it is possible to achieve the impact strength by partially opening the cross-sections of idle openings 16 in guide tube 15. Here it is also possible to provide idle openings 16 with different cross-sections.

We claim:

1. A pneumatic spring hammer device, comprising:

a drive piston that moves axially;

a cavity formed in one end of the drive piston;

an impact piston that moves axially in the cavity of the drive piston between an impact position and an idle position;

a least one ventilation slot formed in the drive piston and positioned to fluidly connect an antechamber situated in front of the impact piston and a hollow space enclosed by the drive piston and the impact piston such that air can flow from the antechamber into the hollow space via the ventilation slot during impact operation of the spring hammer device;

a guide tube positioned about the drive piston such that the drive piston is slidably contained therein;

a plurality of idle openings passing through the guide tube; and a control element having a control opening, the control element being movable between (i) a closed position in which the control element obstructs the idle openings, thereby sealing the hollow space from atmosphere without interfering with flow from the antechamber into the hollow space via the ventilation slot, and (ii) an open position in which the control opening overlies one of the idle openings to fluidly connect the hollow space to atmosphere via the at least one ventilation slot to disable operation of the impact piston independent of the position of the drive piston.

2. The pneumatic spring hammer device according to claim 1, wherein the ventilation slot has a length that is greater than an axial height of a piston head of the impact piston.

3. The pneumatic spring hammer device according to claim 1, wherein the idle openings are obstructed to fluidly separate the antechamber and the hollow space when the drive piston is fully displaced toward the impact piston.

4. The pneumatic spring hammer device according to claim 1, wherein there are the same number of idle openings and control openings that are configured to be aligned along an axial length of the guide tube.

5. The pneumatic spring hammer device according to claim 1, further comprising a spring configured to bias the control element toward an open position.

6. The pneumatic spring hammer device according to claim 1, wherein the control element is a sleeve that surrounds the guide tube.

7. The pneumatic spring hammer device according to claim 6, wherein the guide tube and the sleeve are capable of rotation relative to the drive piston.

8. The pneumatic spring hammer device according to claim 6, wherein the sleeve is axially movable between an open position and a closed position by a selector element that is rotationally fixed relative to a housing of the spring hammer device.

9. The pneumatic spring hammer device according to claim 6, further comprising an annular inner groove formed on an inside surface of the guide tube at the height of each idle opening.

10. A pneumatic spring hammer device, comprising:

a drive piston that moves axially;

a cavity formed in one end of the drive piston;

an impact piston that moves axially in the cavity of the drive piston between an impact position and an idle position;

at least one ventilation slot formed in the drive piston and positioned to fluidly connect a forward volume situated in front of the impact piston and a rearward volume enclosed by the drive piston and the impact piston such that air can flow from the forward volume into the rearward volume via the ventilation slot during translation of the drive piston associated with impact operation of the spring hammer device;

a guide tube positioned about the drive piston such that the drive piston is slidably contained therein;

a plurality of idle openings passing through the guide tube; and a control element that is movable between (i) a closed position in which the control element obstructs the idle openings, thereby fluidly separating a forward volume and a rearward volume that are separated by the impact piston from atmosphere without interfering with fluid flow through the ventilation slot, and (ii) an open position in which the control element fluidly connects, via the at least one ventilation slot, the rearward volume between the drive piston and the impact piston to atmosphere, thereby instantaneously disabling oscillation of the impact piston.

11. The pneumatic spring hammer device of claim 10, wherein the control element includes a same number of control openings as the number of idle openings formed in the guide tube.

12. The pneumatic spring hammer device of claim 11, wherein the number of control openings and the number of idle openings are aligned along a length of the control element.

13. The pneumatic spring hammer device of claim 10, wherein the impact piston includes a piston head that has a length that is insufficient to simultaneously obstruct all of the idle openings.

14. The pneumatic spring hammer device of claim 10, wherein the forward volume and the rearward volume are fluidly separated when the drive piston is fully displaced toward the impact piston.

15. The pneumatic spring hammer device of claim 10, further comprising a spring configured to bias the control element toward the open position.

* * * * *